US006506102B2

(12) United States Patent
Kordonski et al.

(10) Patent No.: US 6,506,102 B2
(45) Date of Patent: Jan. 14, 2003

(54) SYSTEM FOR MAGNETORHEOLOGICAL FINISHING OF SUBSTRATES

(76) Inventors: William Kordonski, 712 Mariner Cir., Webster, NY (US) 14580; Stephen Hogan, 1355 Middle Rd., Rush, NY (US) 14543; Jerry Carapella, 7 Old Brick Cir., Pittsford, NY (US) 14534; Andrew S. Price, 500 Licia La., Webster, NY (US) 14580

( * ) Notice: Subject to any disclaimer, the term of this patent is extended or adjusted under 35 U.S.C. 154(b) by 30 days.

(21) Appl. No.: 09/775,282

(22) Filed: Feb. 1, 2001

(65) Prior Publication Data

US 2002/0102928 A1 Aug. 1, 2002

(51) Int. Cl.[7] ..... B24B 7/00
(52) U.S. Cl. ..... 451/64; 451/36; 451/60
(58) Field of Search ..... 451/64, 36, 60, 451/87, 93

(56) References Cited

U.S. PATENT DOCUMENTS 5,616,066 A * 4/1997 Jacobs et al. ..... 451/113
5,839,944 A * 11/1998 Jacobs et al. ..... 451/178
5,951,369 A 9/1999 Kordonski et al.

* cited by examiner

*Primary Examiner*—George Nguyen
*Assistant Examiner*—Dung Van Nguyen
(74) *Attorney, Agent, or Firm*—Neal L. Slifkin; Harris Beach LLP

(57) ABSTRACT

An improved system for magnetorheological finishing of a substrate comprising a vertically oriented bowl-shaped carrier wheel having a horizontal axis. The carrier wheel is preferably an equatorial section of a sphere, such that the carrier surface is spherical. The wheel includes a radial circular plate connected to rotary drive means and supporting the spherical surface which extends laterally from the plate. An electromagnet having planar north and south pole pieces is disposed within the wheel, within the envelope of the sphere and preferably within the envelope of the spherical section defined by the wheel. The magnets extend over a central wheel angle of about 120° such that magnetorheological fluid is maintained in a partially stiffened state ahead of and beyond the work zone. A magnetic scraper removes the MRF from the wheel as the stiffening is relaxed and returns it to a conventional fluid delivery system for conditioning and re-extrusion onto the wheel. The system is useful in finishing large concave substrates, which must extend beyond the edges of the wheel, as well as for finishing very large substrates in a work zone at the bottom dead center position of the wheel.

4 Claims, 7 Drawing Sheets

SYSTEM FOR MAGNETORHEOLOGICAL FINISHING OF SUBSTRATES

BACKGROUND OF THE INVENTION

1. Field of the Invention

The present invention relates to systems for slurry-based abrasive finishing and polishing of substrates; more particularly, to such systems employing magnetorheological fluids (MRF) and magnets adjacent to a spherical carrier wheel for magnetically stiffening the fluid in a work zone on the wheel; and most particularly, to an improved system wherein the stiffening magnets are disposed within the wheel itself.

2. Discussion of the Related Art

Use of magnetically-stiffened magnetorheological fluids for abrasive finishing and polishing of substrates is well known. Such fluids, containing magnetically-soft abrasive particles dispersed in a liquid carrier, exhibit magnetically-induced plastic behavior in the presence of a magnetic field. The apparent viscosity of the fluid can be magnetically increased by many orders of magnitude, such that the consistency of the fluid changes from being nearly watery to being a very stiff paste. When such a paste is directed appropriately against a substrate surface to be shaped or polished, for example, an optical element, a very high level of finishing quality, accuracy, and control can be achieved.

U.S. Pat. No. 5,951,369 issued Sep. 14, 1999 to Kordonski et al., the disclosure of which is hereby incorporated by reference, discloses methods, fluids, and apparatus for deterministic magnetorheological finishing of substrates. This patent is referred to herein as "'369."

In a typical magnetorheological finishing system, such as is disclosed in the '369 patent, a work surface comprises a vertically-oriented wheel having an axially-wide rim which is undercut symmetrically about a hub. Specially shaped magnetic pole pieces are extended toward opposite sides of the wheel under the undercut rim to provide a magnetic work zone on the surface of the wheel, preferably at about the top-dead-center position. The surface of the wheel is preferably an equatorial section of a sphere.

Mounted above the work zone is a substrate receiver, such as a chuck, for extending a substrate to be finished into the work zone. The chuck is programmably manipulable in a plurality of modes of motion and is preferably controlled by a programmable controller or a computer.

Magnetorheological fluid is extruded in a non-magnetized state from a shaping nozzle as a ribbon onto the work surface of the wheel, which carries it into the work zone where it becomes magnetized to a pasty consistency. In the work zone, the pasty MRF does abrasive work, known as magnetorheological polishing or finishing, on the substrate. Exiting the work zone, the concentrated fluid on the wheel becomes non-magnetized again and is scraped from the wheel work surface for recirculation and reuse.

Fluid delivery to, and recovery from, the wheel is managed by a closed fluid delivery system such as is disclosed in the '369 reference. MRF is withdrawn from the scraper by a suction pump and sent to a tank where its temperature is measured and adjusted to aim. Recirculation from the tank to the nozzle, and hence through the work zone, at a specified flow rate is accomplished by setting the speed of rotation of a pressurizing pump, typically a peristaltic pump. Because the peristaltic pump exhibits a pulsating flow, a pulsation dampener is required downstream of the pump.

The rate of flow of MRF supplied to the work zone is highly controlled. An inline flowmeter is provided in the fluid recirculation system and is connected via a controller to regulate the rotational speed of the pump.

A capillary viscometer is disposed in the fluid delivery system at the exit thereof onto the wheel surface. Output signals from the flowmeter and the viscometer are inputted to an algorithm in a computer which calculates the apparent viscosity of MRF being delivered to the wheel and controls the rate of replenishment of carrier fluid to the recirculating MRF in a mixing chamber ahead of the viscometer, to adjust the apparent viscosity to aim.

The prior art MRF finishing system just described is unsuited to two finishing requirements which have recently emerged.

First, because the magnet pole pieces are extended under the edge of the wheel from outside the envelope of the sphere from which the wheel is derived, on substantially a tangent to the spherical surface, the prior art system cannot finish large concave objects such as large lenses having a radius of curvature on the order of the radius of the wheel, because of steric interference of the pole pieces.

Second, because the pole pieces extend radially over a comparatively small central angle of the wheel, the prior art system is useful for finishing of workpieces only when they are disposed at or near the top dead center position of the carrier wheel and thus is limited to finishing substrates which may be mounted and manipulated by an overhead chuck.

OBJECTS OF THE INVENTION

It is a principal object of the invention to provide a system for magnetorheological finishing of concave substrates wherein the radius of the concavity is comparable to the radius of the carrier wheel.

It is a further object of the invention to provide a system for magnetorheological finishing of substrates wherein the finishing may be carried out at any desired angular orientation of the work zone on the carrier wheel.

It is a still further object of the invention to provide a system for magnetorheological finishing of large substrates wherein the substrate is positioned on a controllable bed, the carrier wheel is positioned over the substrate, and a work zone is provided at the bottom dead center position on the carrier wheel and may be moved over the substrate.

BRIEF DESCRIPTION OF THE INVENTION

Briefly described, an improved system for magnetorheological finishing of a substrate in accordance with the invention comprises a vertically oriented carrier wheel having a horizontal axis. The carrier wheel is preferably an equatorial section of a sphere, such that the carrier surface is spherical. The wheel is generally bowl-shaped, comprising a circular plate connected to rotary drive means and supporting the spherical surface which extends laterally from the plate. An electromagnet having planar north and south pole pieces is disposed within the wheel, within the envelope of the sphere and preferably within the envelope of the spherical section defined by the wheel. The magnets extend over a central wheel angle of about 120° such that magnetorheological fluid is maintained in a partially stiffened state well ahead of and well beyond the work zone. A magnetic scraper removes the MRF from the wheel as the stiffening is relaxed and returns it to a conventional fluid delivery system for conditioning and re-extrusion onto the wheel. The placement of the magnets within the wheel provides unencumbered space on either side of the carrier surface such that large concave substrates, which must extend beyond the edges of the wheel, may be accommodated for finishing. The angular extent of the magnets causes the MRF to be retained on the wheel over an extended central angle thereof, permitting orientation and finishing in a work zone at the bottom dead center position of the wheel.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
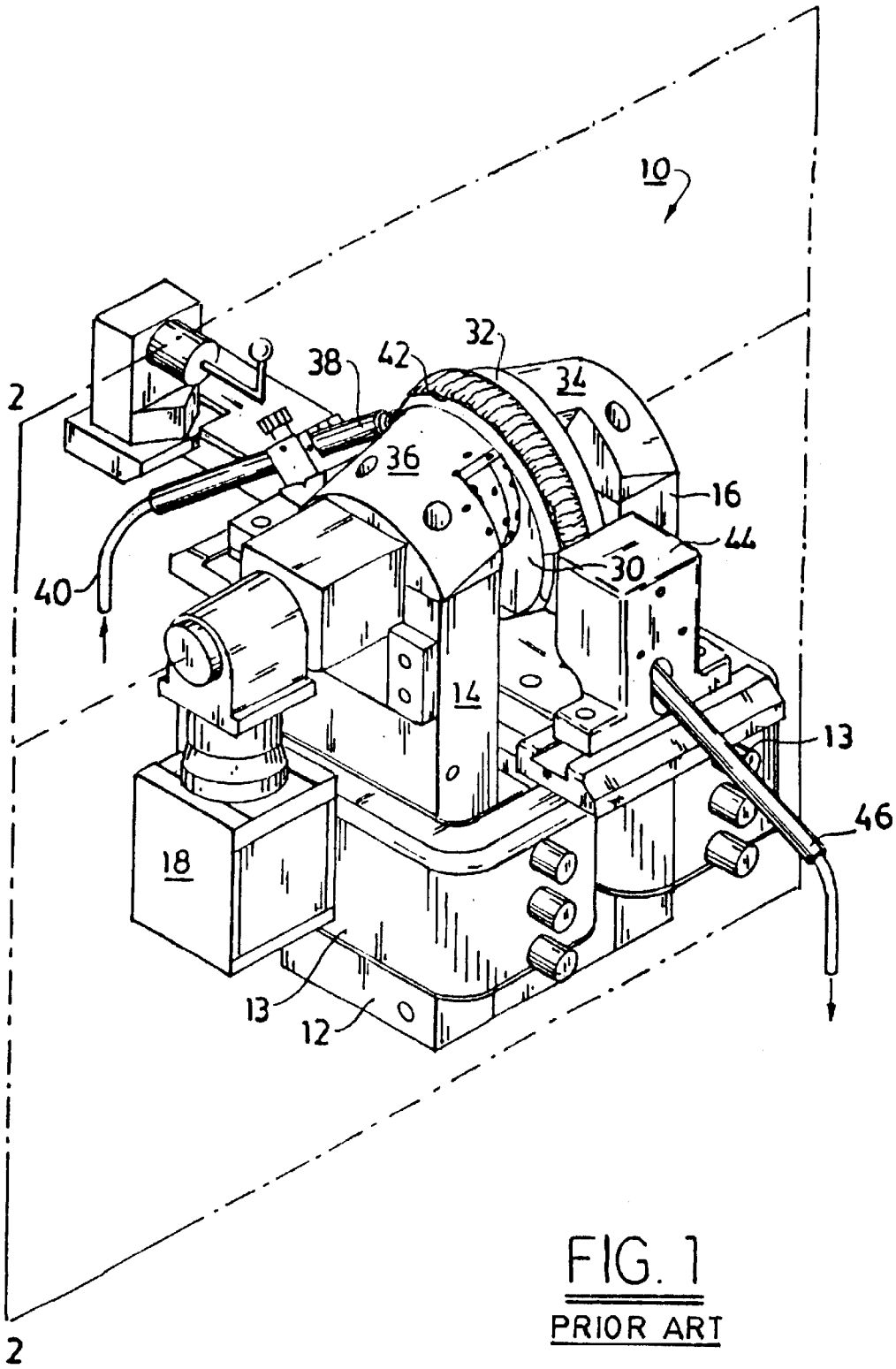
FIG. 1 PRIOR ART
FIG. 1 is an isometric view from above of the mechanical assembly portion of a prior art substrate finishing apparatus, substantially as shown in the '369 patent.
Figure 2:
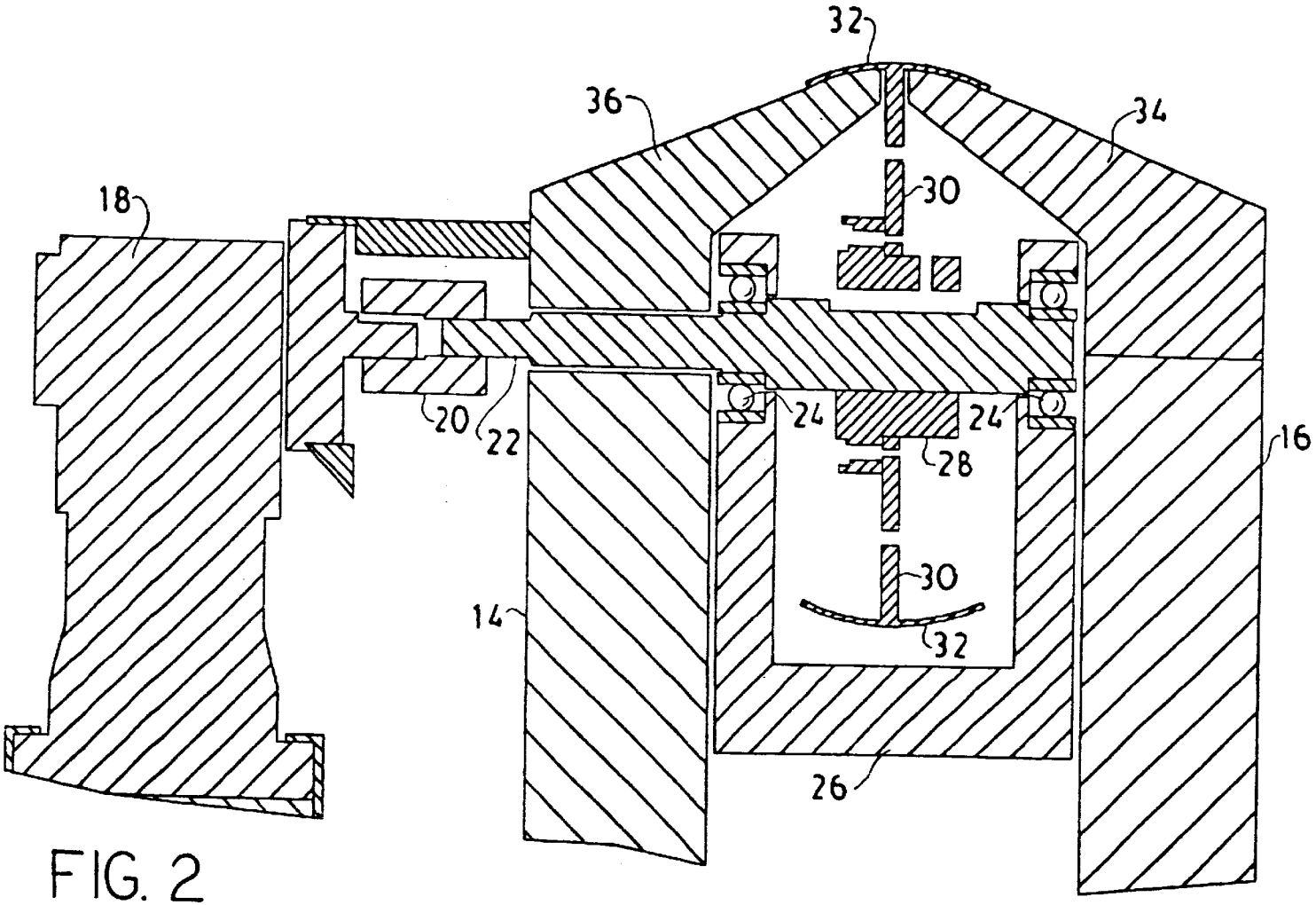
FIG. 2 PRIOR ART
FIG. 2 is an elevational cross-sectional view taken through plane 2—2 in FIG. 1.

In FIGS. 1 and 2 is shown the overall layout of a mechanical assembly portion 10 of a system in accordance with the prior art for magnetorheological finishing of a substrate. Portion 10 includes a base 12 which supports the core of a magnet, preferably the core and windings 13 of an electromagnet, and supports left and right magnet yoke members 14,16, respectively, which are connected conventionally to the core. Yoke 14 supports a motor drive unit 18 coupled via coupling 20 to a shaft 22 journalled in bearings 24 and supported by a pedestal 26. Drive unit 18 is controlled by a drive controller (not shown) in conventional fashion to control the rotational speed of the drive at a desired aim. Shaft 22 is rotatably coupled to the hub 28 of a carrier wheel flange 30 supporting a peripheral surface 32 which extends axially of flange 30 to both sides thereof, preferably symmetrically. Surface 32, which is the work surface or carrier surface of the apparatus, may be substantially flat, i.e., have curvature in only the circumferential direction, defining a cylindrical section, or preferably surface 32 may also be arcuate in the axial direction, defining a convexity (as shown in FIG. 2). Mounted on yoke members 14,16 are left and right magnet polepieces 34,36, respectively, which extend under surface 32 substantially tangentially thereto. The magnet may be alternatively oriented and operated such that polepieces 34,36 are magnetically north and south or south and north, respectively, to equal effect. An application nozzle 38 is connected to supply line 40 for providing a ribbon 42 of MRF onto moving work surface 32, and a scraper 44 is connected to return line 46 for removing MRF from work surface 32 and returning MRF to a recirculating and conditioning system (not shown in FIGS. 1 and 2). Scraper 44 is preferably magnetically shielded.

Figure 3:
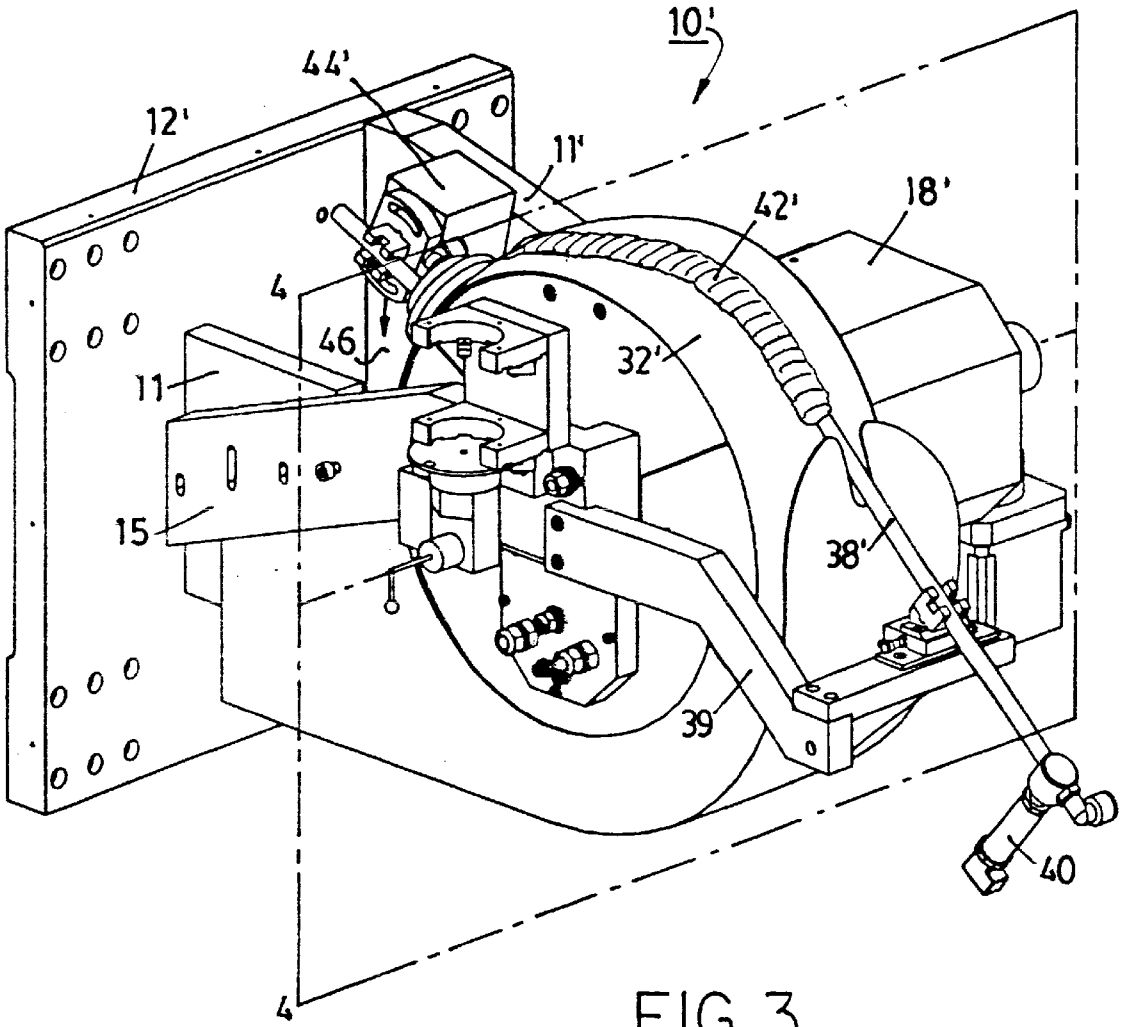
FIG. 3 is an isometric view from above of the mechanical assembly portion of a first embodiment of an improved substrate finishing apparatus in accordance with the invention.
Figure 4:
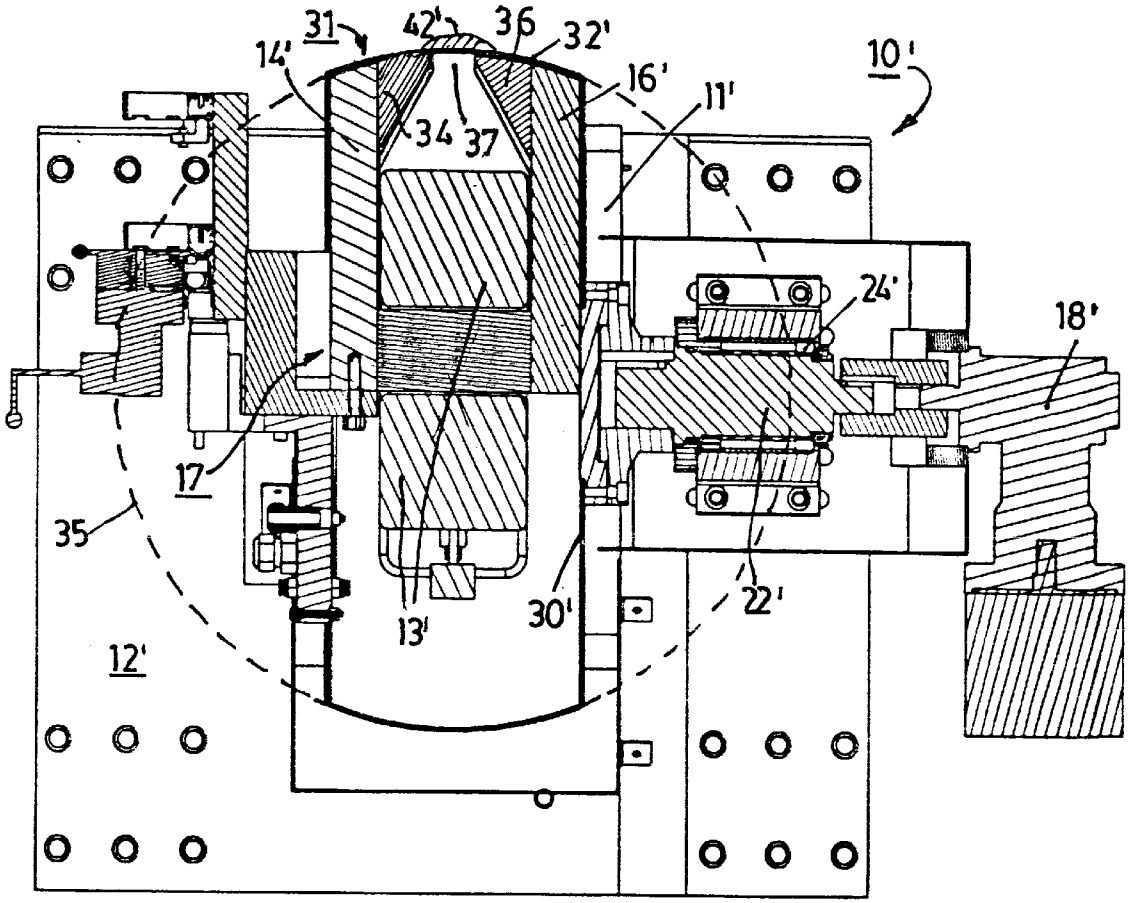
FIG. 4 is an elevational cross-sectional view taken through plane 4—4 in FIG. 3.
Figure 5:
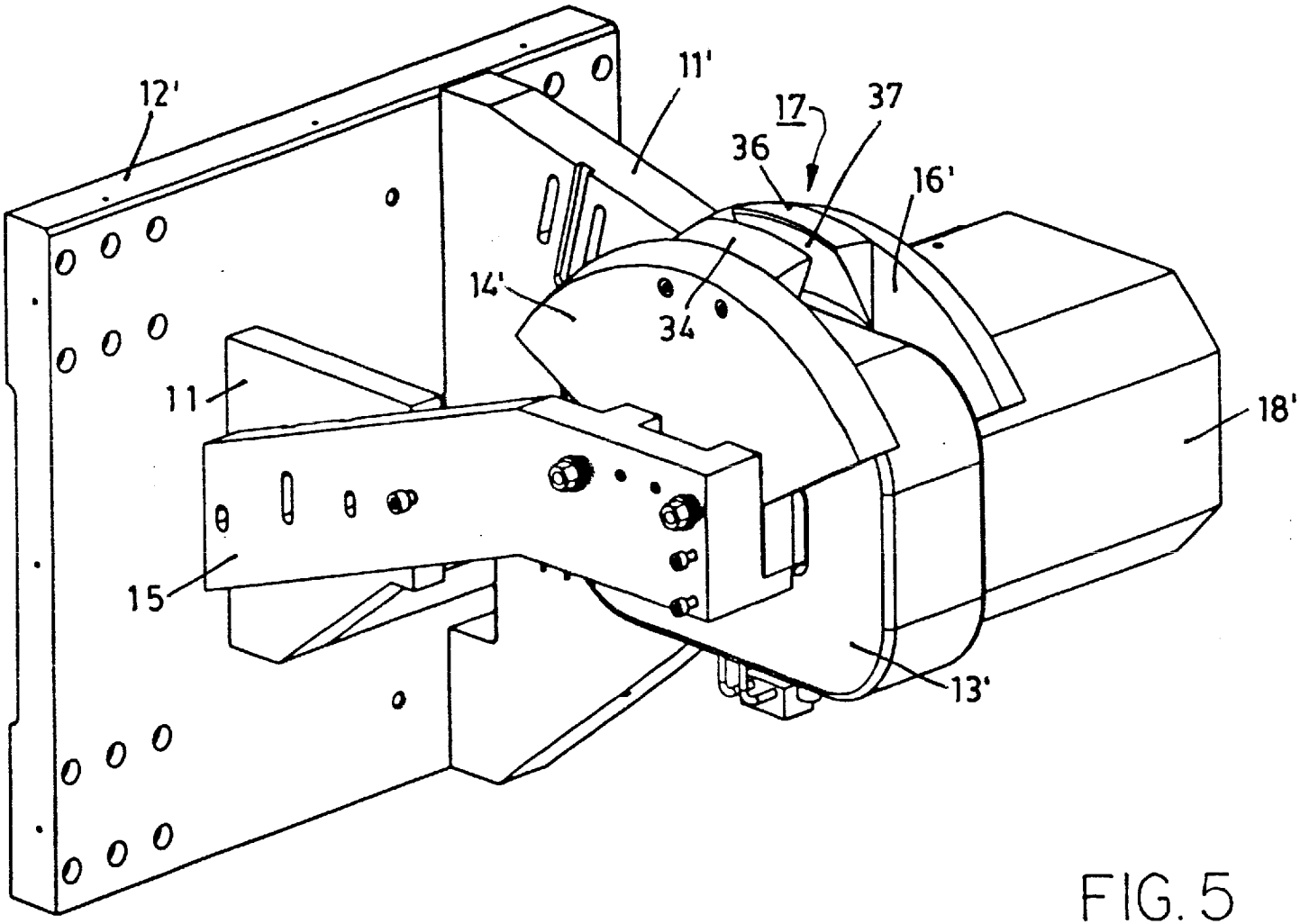
FIG. 5 is an isometric view like that shown in FIG. 3 but with the carrier wheel and fluid-handling components removed to show the arrangement of magnets as normally disposed within the wheel.

In FIGS. 3–5 is shown the overall layout of a mechanical assembly portion 10' of a system in accordance with the present invention for magnetorheological finishing of a substrate. Portion 10' includes a base 12', first bracket 11, and arm 15 for supporting as by bolts a magnet assembly 17, preferably the core and windings 13' of an electromagnet and left and right magnet yoke members 14',16', respectively, which are preferably planar slabs having radial ends conformable to the carrier wheel, as shown in FIGS. 4 and 5, and which are connected conventionally to the core. Second bracket 11' extending from base 12' supports a shaft 22' journalled in bearings 24' and a motor drive unit 18' cantilevered therefrom. Drive unit 18' is controlled by a drive controller (not shown) in conventional fashion to control the rotational speed of the drive at a desired aim. Shaft 22' is rotatably coupled to a carrier wheel flange 30' supporting a peripheral surface 32' which extends from flange 30' in the direction away from drive unit 18'. Flange 30' and surface 32' together define a generally bowl-shaped carrier wheel 31 which is open on the side opposite flange 30' for receiving magnet assembly 17. Surface 32', which is the work surface or carrier surface of the apparatus, may be substantially flat, i.e., have curvature in only the circumferential direction, defining a cylindrical section, or preferably surface 32' may also be arcuate in the axial direction, defining a convexity (as shown in FIG. 2). Preferably, surface 32' is an equatorial section of a sphere. Magnet assembly 17 is disposed within the envelope 35 of a sphere of which surface 32' is a section, and preferably is contained within the geometric confines of surface 32' itself as shown in FIG. 4. Steric hindrance to finishing concave substrates broader than the axial width of surface 32 or 32', as presented by polepieces 34,36 in prior art apparatus 10, is thus eliminated.

Figure 6:
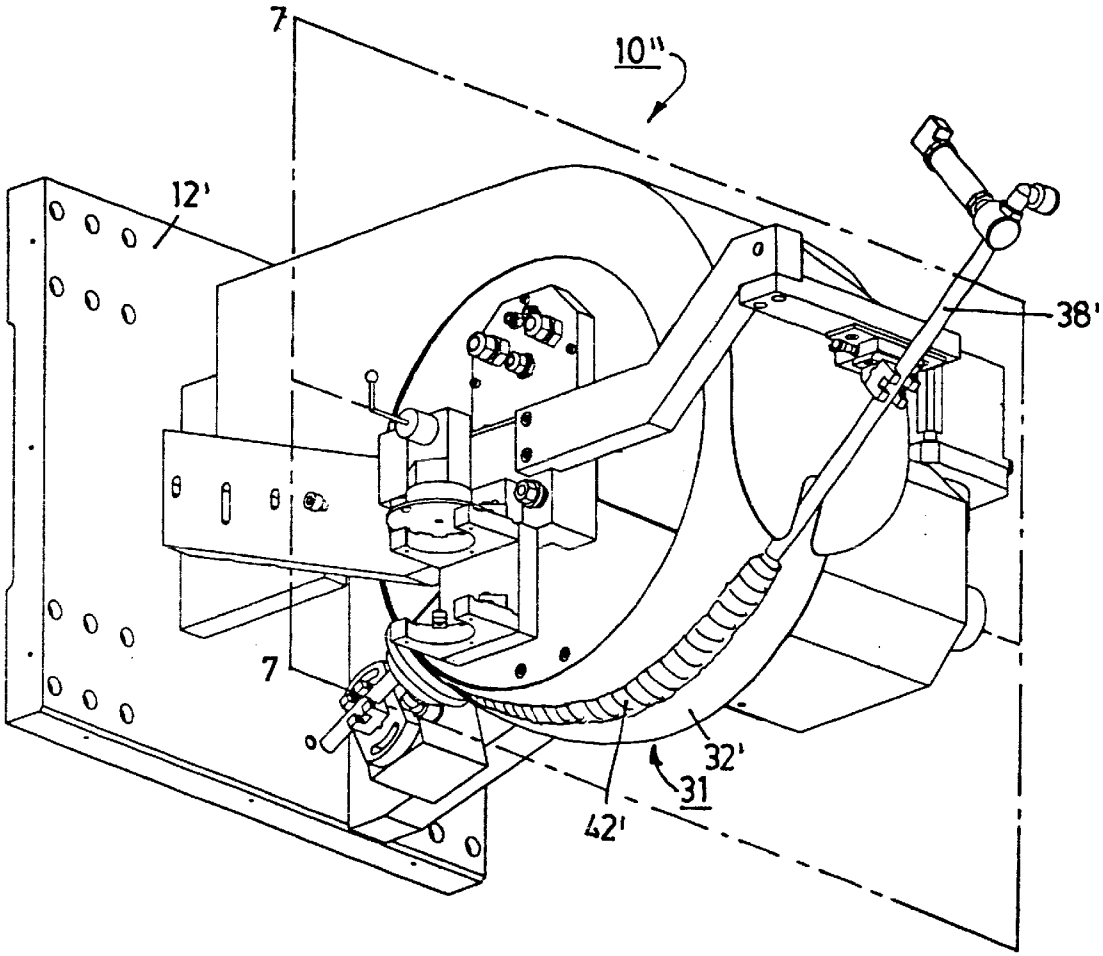
FIG. 6 is an isometric view from below of the mechanical assembly portion of a second embodiment of an improved substrate finishing apparatus in accordance with the invention.
Figure 7:
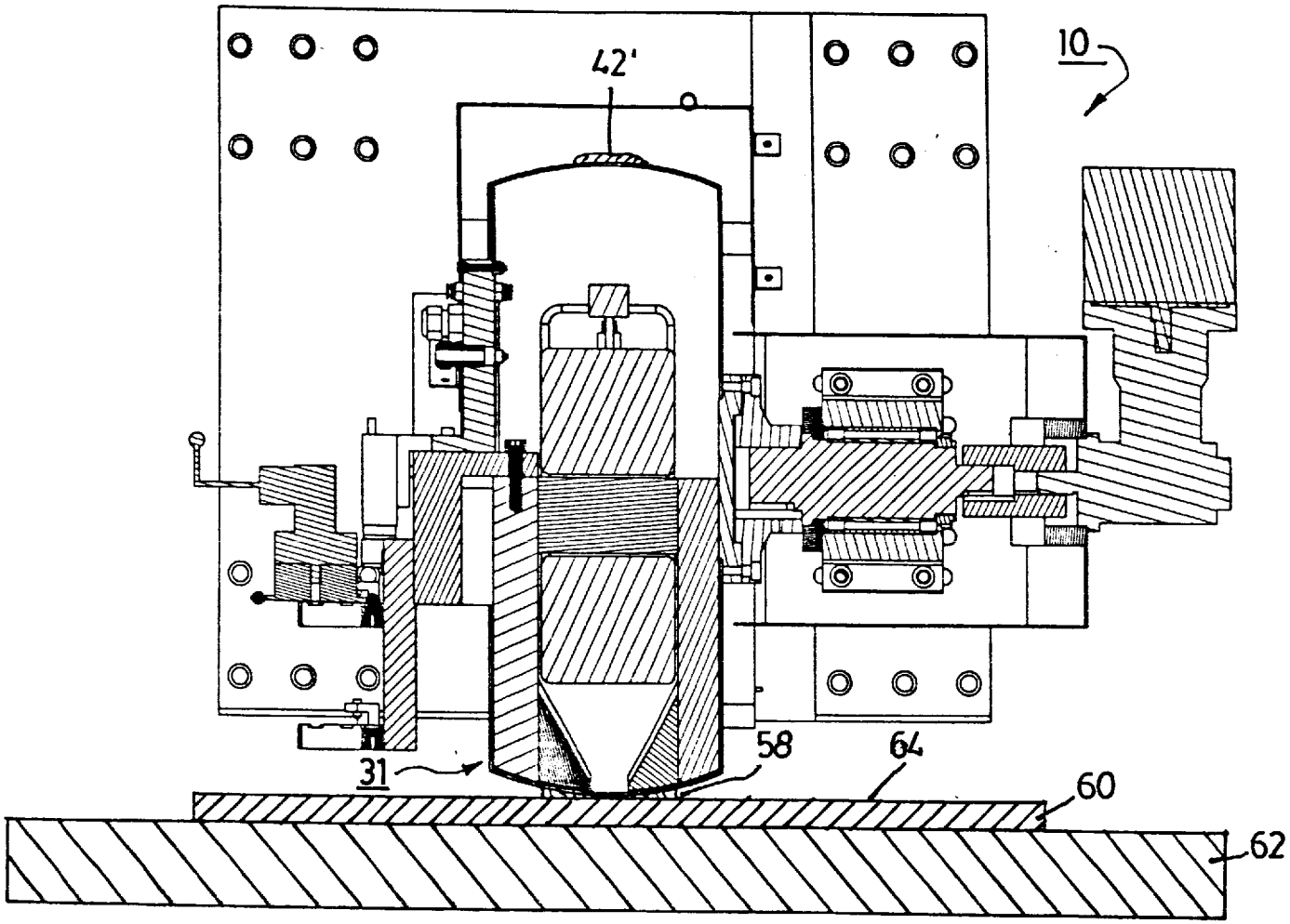
FIG. 7 is an elevational cross-sectional view of the apparatus shown in FIG. 6 taken through plane 7—7, showing the apparatus in use for finishing an upper surface of a large substrate on a movable bed.

Mounted on yoke members 14',16' are left and right magnet polepieces 34',36', respectively, extending towards one another and separated by a magnetic gap 37. Whereas yoke members 14',16' preferably extend over a central angle of the carrier wheel of about 120°, the polepieces 34',36' extend over a much smaller central angle, preferably about 20°. Thus a broad magnetic field is present over a large central angle, enabling the apparatus to retain MRF on the carrier surface in a semi-stiffened state in opposition to gravity, permitting a finishing work zone at any desired radial orientation of the apparatus, including at the bottom dead center position of the wheel, as shown in FIGS. 6 and 7 and described further below. A narrow and intense magnetic field, a part of a fringing field formed in the gap between the polepieces, is present in the work zone.

The magnet assembly may be alternatively oriented and operated such that polepieces 34',36' are magnetically north and south or south and north, respectively, to equal effect. An application nozzle 38', supported by bracket 39 extending from arm 15, is connected to supply line 40' for providing a ribbon 42' of MRF onto moving work surface 32', and a scraper 44' is connected to return line 46' for removing MRF from work surface 32' and returning MRF to a recirculating and conditioning system in known fashion (not shown in FIGS. 3–5). Scraper 44' is preferably magnetically shielded.

Preferably, the radial ends of yoke members 14',16' extend over substantially the full path of contact of the MRF ribbon on the carrier surface, between the point of application from the nozzle and the point of removal by the scraper. It is an advantage of a finisher in accordance with the invention that the nozzle and the scraper may be disposed at essentially any desired radial location, including much farther apart than shown in FIG. 3, such that large and deep concavities having a radius comparable to the radius of the carrier wheel may be polished without hindrance from the nozzle and scraper.

Referring to FIGS. 6 and 7, a second embodiment 10" of a magnetorheological finisher in accordance with the present invention is substantially identical in design with first embodiment 10'. However, the apparatus is arranged so that a work zone 58 can be formed at the bottom dead center position of carrier wheel 31. This permits use of the apparatus for an entirely new function, the finishing of very large substrates such as astronomical mirrors. Such substrates are too large and cumbersome to be handled in an overhead chuck connected to a 5-axis positioning machine, as in the known art. Such a substrate, shown as substrate 60 in FIG. 7, may conveniently be mounted on a substage or bed 62 which may be connected to a computer-controlled 5-axis positioning machine in known fashion (not shown in FIG. 7), whereby any desired surface contour may be finished on the upper surface 64 of substrate 60.

From the foregoing description it will be apparent that there has been provided an improved system for magnetorheological finishing of substrates wherein the magnet system is contained within the spherical envelope of the carrier wheel, thus eliminating steric hindrances adjacent the wheel, and wherein the system can retain magnetorheological fluid on the carrier surface at any angle of orientation of the work zone, thus permitting the finishing of large substrates mounted below the system. Variations and modifications of the herein described finishing system, in accordance with the invention, will undoubtedly suggest themselves to those skilled in this art. Accordingly, the foregoing description should be taken as illustrative and not in a limiting sense.

What is claimed is:

1. A system for magnetorheological finishing of substrates, comprising:

a) a frame;

b) a carrier wheel rotatably mounted on said frame, said wheel having a hollow interior, the outer surface of said wheel defining a carrier surface for magnetorheological fluid in a work zone, said carrier wheel being an equatorial section of a sphere;

c) a magnet system mounted on said frame for stiffening said magnetorheological fluid on said carrier surface, said magnet system being disposed within the projected envelope of said sphere and including an electromagnet having windings about a core;

first and second yoke pieces attached to opposite ends of said core and extending substantially parallel into proximity with an inner wall of said carrier surface; and first and second pole pieces attached respectively to and between said first and second yoke pieces and extending toward each other to define a magnetic gap therebetween adjacent said inner wall for creating a magnetic field in a work zone on said carrier surface.

2. A system in accordance with claim 1 wherein said first and second yoke pieces extend over a central angle of said carrier wheel of about 120°.

3. A system in accordance with claim 1 wherein said work zone is present on said carrier surface at about a top dead center position of said carrier wheel.

4. A system in accordance with claim 1 wherein said work zone is present on said carrier surface at about a bottom dead center position of said carrier wheel.

* * * * *